US006694992B2

(12) United States Patent
Gaskins

(10) Patent No.: US 6,694,992 B2
(45) Date of Patent: Feb. 24, 2004

(54) WET UMBRELLA HOLDER

(76) Inventor: Rubylene Gaskins, 11108 Constellation Ave., Ft. Washington, MD (US) 20744

( * ) Notice: Subject to any disclaimer, the term of this patent is extended or adjusted under 35 U.S.C. 154(b) by 0 days.

(21) Appl. No.: 10/109,653

(22) Filed: Apr. 1, 2002

(65) Prior Publication Data

US 2003/0183260 A1 Oct. 2, 2003

(51) Int. Cl.[7] ..... A45B 25/24

(52) U.S. Cl. ..... 135/34.2; 224/915; 383/4; 383/117

(58) Field of Search ..... 135/34.2, 25.41, 135/16; 224/915, 600, 614; 383/4, 16–17, 117

(56) References Cited

U.S. PATENT DOCUMENTS 442,991 A * 12/1890 McKevit ..... 135/34.2
1,081,788 A * 12/1913 Terry ..... 206/581
2,028,337 A * 1/1936 Lane ..... 135/34.2
2,212,390 A * 8/1940 Conklin ..... 383/2
2,522,604 A * 9/1950 Courter ..... 135/34.2
3,744,502 A * 7/1973 Weber ..... 135/25.4
3,746,066 A * 7/1973 McIntyre ..... 150/107
5,323,802 A * 6/1994 Kiedrowski ..... 135/34.2
6,015,077 A * 1/2000 Disher ..... 224/666

* cited by examiner

*Primary Examiner*—Winnie Yip
(74) *Attorney, Agent, or Firm*—Kerry S. Culpepper; Posz & Bethards, PLC

(57) ABSTRACT

A holder for wet articles such as umbrellas includes a liquid absorbent interior portion and a leak resistant exterior portion. The liquid absorbent interior portion includes a central cavity for receiving the wet article and access means for extending the interior portion from the exterior portion. A connector portion connects the interior portion to the exterior portion. The holder may also include an adjustment strap that restricts access to the central cavity within the interior portion.

5 Claims, 3 Drawing Sheets

WET UMBRELLA HOLDER

CROSS REFERENCE TO RELATED APPLICATIONS

Not applicable

STATEMENT REGARDING FEDERALLY SPONSORED RESEARCH OR DEVELOPMENT

Not applicable

BACKGROUND OF THE INVENTION (1) Field of the Invention

The present invention relates to article holders. More specifically, the present invention relates to a holder for wet articles such as umbrellas.

(2) Description of the Related Art

Umbrellas, or other similar articles, protect individuals from rain or other weather elements. However, when individuals carrying umbrellas enter premises from the outside, these umbrellas must be properly stored. A wet umbrella in a store, or bus, can spill water on a carpet, or on a bus seat. Such water spillage can cause damage to a floor or a clothing of the individual. In addition, such water spillage can lead to embarrassment for the individual carrying the umbrella.

Numerous facilities require individuals to leave their umbrellas at the entrance prior to entering the facility. However, such a policy can lead to umbrellas being misplaced, or stolen.

BRIEF SUMMARY OF THE INVENTION

It is an object of the present invention to provide a, wet umbrella holder that prevents water spillage. It is also an object of the present invention to provide a wet umbrella holder that is portable, simple and convenient to use.

These objects are achieved by providing a wet umbrella holder with a water resistant exterior portion connected to a water absorbent interior portion in such a manner as to define a central cavity for receiving a wet umbrella.

BRIEF DESCRIPTION OF THE SEVERAL VIEWS OF THE DRAWINGS

A preferred embodiment of the present invention is described in detail below with reference to the attached drawings, wherein.

DETAILED DESCRIPTION OF THE INVENTION

Figure 1:
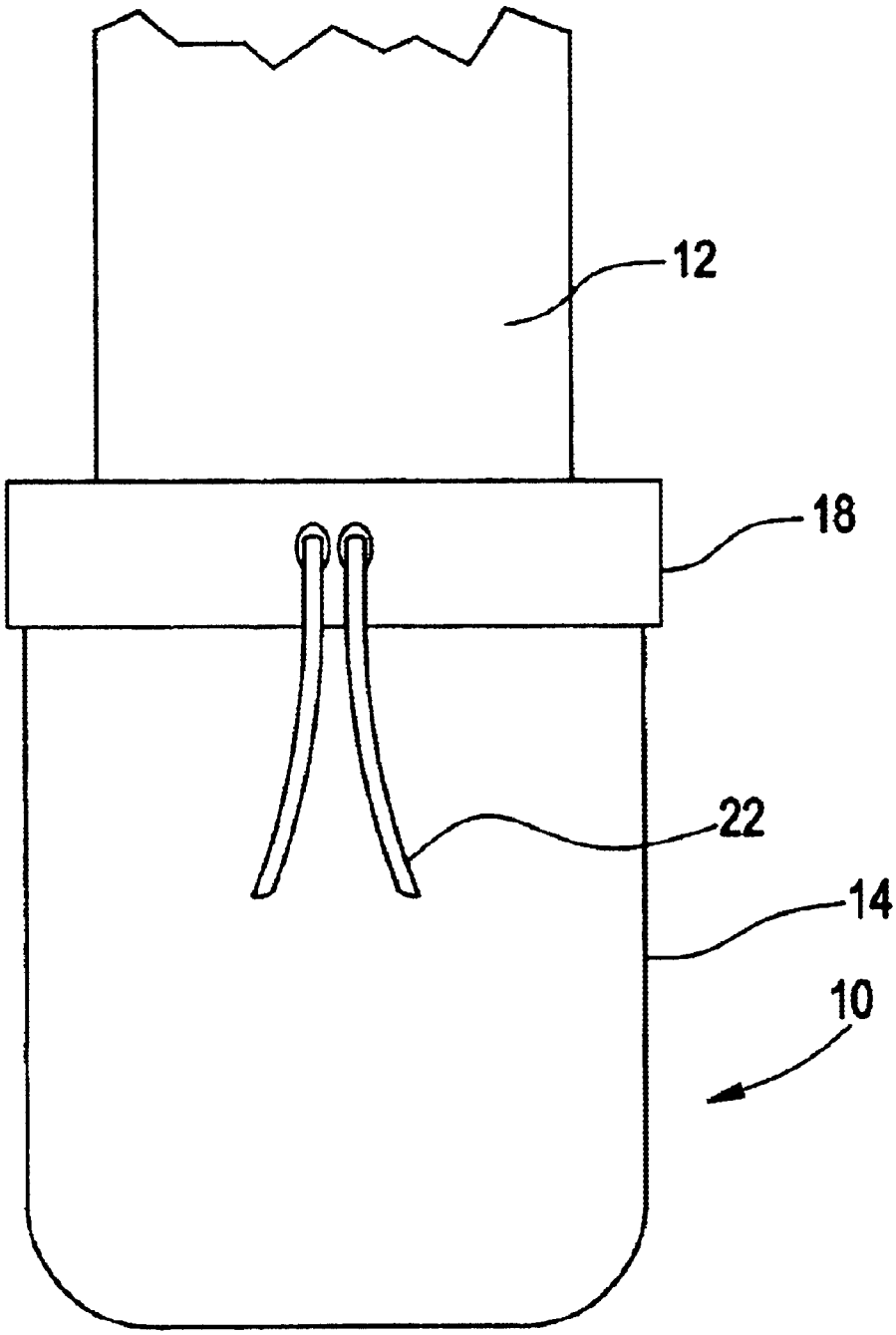
FIG. 1 shows a view of the wet umbrella holder of the present invention in its operating environment.
Figure 2:
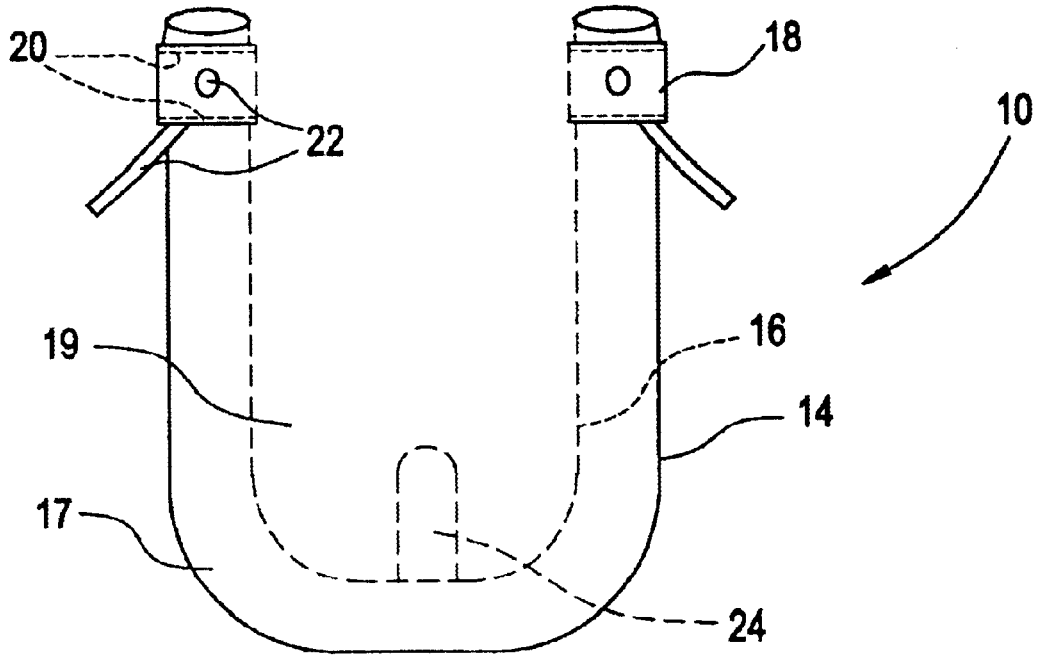
FIG. 2 shows a front view of the wet umbrella holder with the water absorbent interior portion within the water resistant exterior portion.

A wet umbrella holder 10 of the present invention is shown in its operating environment in FIG. 1. An umbrella 12 fits in the wet umbrella holder 10. Referring to FIG. 2, the wet umbrella holder 10 includes a pouch-shaped water resistant exterior portion (exterior portion) 14 and a pouch-shaped water absorbent interior portion (interior portion) 16. The exterior portion 14 can be any common water resistant material, such as vinyl. The interior portion 16 can be any common water absorbent material, such as terrycloth.

A connector portion 18 connects the exterior portion 14 with the interior portion 16. More specifically, the connection portion 18 is connected to a top portion of the exterior portion 14 and a top portion of the interior portion 16. The connection between the interior portion 16 and the exterior portion 14 is made while the interior portion 16 is within the exterior portion 14 and with a small space 17 between the exterior portion 14 and the interior portion 16. The connection between the exterior portion 14 and the interior portion 16 preserves a central cavity 19 within the interior portion 16.

Stitching, for example, can be utilized to make the connection between the connection portion 18, the exterior portion 16 and the interior portion 14. Preferably, two lines of stitching 20 make the connection. An adjustment strap 22 is provided within the small space 17 and in between the two lines of stitching 20. One adjustment strap, or more than two adjustment straps or other adjustment means such as Velcro® can be used.

Figure 3:
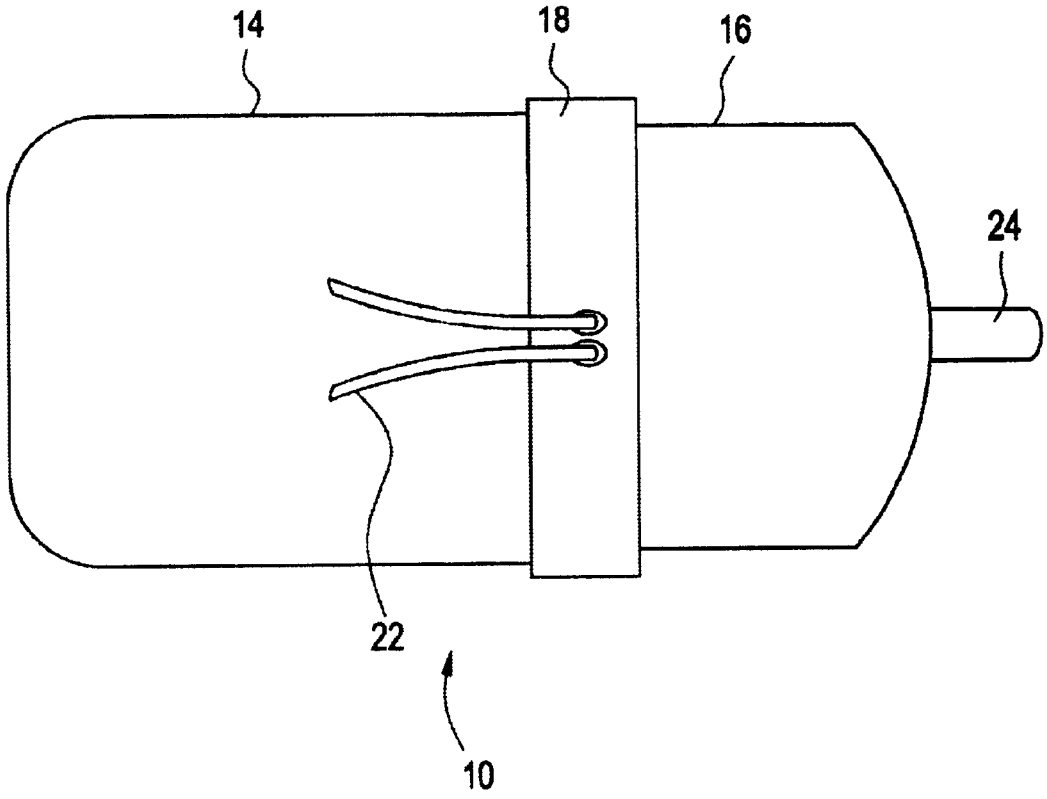
FIG. 3 shows a front view of the wet umbrella holder with the water absorbent interior portion extended from within the water resistant exterior portion.

A pull-tab 24 can optionally be provided on a bottom portion of the interior portion 16 within the central cavity 19. Referring to FIG. 3, the pull-tab 24 can be used to extend the interior portion 14 from the exterior portion 16.

In use, an umbrella 12 that is wet is inserted into the central cavity 19. The adjustment straps 22 are then manipulated by, for example, pulling to tighten the position of the umbrella 12 within the central cavity 19. The water absorbent material of the interior portion 16 absorbs water from the umbrella 12 and the water resistant material of the exterior portion 14 prevents water spillage from the wet umbrella holder 10 when it is maintained in an upright position.

The user can subsequently remove the umbrella 12 from the wet umbrella holder 10 by manipulating the adjustment strap 22 to expand the size of the central cavity.

The user can reach in the central cavity 19 and pull the pull-tab 24 to extend the interior portion 16 from the exterior portion 24. The interior portion 16 can then be air dried.

Although the present invention has been described with reference to preferred embodiments, one skilled in this art may make numerous revisions in form and detail, and such revisions are intended to fall within the scope of the following claims.

What is claimed is:

1. An article holder for storing a wet article comprising:

a leak resistant exterior portion for preventing spillage;

a liquid absorbent interior portion with a central cavity for receiving the wet article and absorbing excess liquid from the wet article;

a connector portion for connecting a top portion of the leak resistant exterior portion with a top portion of the liquid absorbent interior portion; and a pull-tab connected to a bottom portion of the liquid absorbent interior portion, wherein the pull-tab is for pulling the liquid absorbent interior portion outwardly from the leak resistant exterior portion to thereby dry the liquid absorbent interior portion.

2. The article holder of claim 1, further comprising at least one adjustment strap within the connector portion for adjusting access to the central cavity.

3. The article holder of claim 1, wherein the liquid absorbent interior portion comprises terrycloth.

4. An article holder for storing a wet article comprising:

a leak resistant exterior portion for preventing spillage;

a liquid absorbent interior portion with a central cavity for receiving the wet article and absorbing excess liquid from the wet article;

a connector portion for connecting a top portion of the leak resistant exterior portion with a top portion of the liquid absorbent interior portion; and a pull-tab connected to a bottom portion of the liquid absorbent interior portion, wherein the pull-tab is for pulling the liquid absorbent interior portion outwardly from the leak resistant exterior portion to thereby dry the liquid absorbent interior portion, wherein the liquid resistant exterior portion comprises plastic material.

5. A wet umbrella holder comprising:

a water resistant pouch shaped hollow exterior portion;

a water absorbent pouch shaped hollow interior portion having a central cavity for receiving a wet umbrella;

a connector portion for connecting a top portion of the exterior portion with a top portion of the interior portion; and a pull-tab on a bottom section of the interior portion for pulling the interior portion outwardly from the exterior portion to thereby dry the interior portion, wherein the connector portion includes manipulation means.

* * * * *